US007777111B1

(12) United States Patent
North

(10) Patent No.: US 7,777,111 B1
(45) Date of Patent: Aug. 17, 2010

(54) FOOT OPERATED PERCUSSIVE INSTRUMENT

(76) Inventor: Matthew North, 439 1/2 S. Palm Dr., Beverly Hills, CA (US) 90212

( * ) Notice: Subject to any disclaimer, the term of this patent is extended or adjusted under 35 U.S.C. 154(b) by 0 days.

(21) Appl. No.: 12/172,080

(22) Filed: Jul. 11, 2008

(51) Int. Cl.
*G10D 13/06* (2006.01)
*G10D 13/02* (2006.01)

(52) U.S. Cl. ..... 84/402; 84/418; 84/422.1

(58) Field of Classification Search ..... 84/402, 84/418, 422.1; 446/26
See application file for complete search history.

(56) References Cited

U.S. PATENT DOCUMENTS 1,613,978 A * 1/1927 Berton ..... 84/402
1,744,513 A * 1/1930 Smith ..... 36/8.3
1,943,222 A * 1/1934 Landi ..... 36/8.3
2,291,791 A * 8/1942 Casserd ..... 36/8.3
2,320,560 A * 6/1943 Braddock ..... 446/26
2,475,542 A * 7/1949 Boykins ..... 84/422.1
2,484,898 A * 10/1949 MacDonald ..... 446/26
2,644,248 A * 7/1953 Seligman ..... 36/7.5
2,735,220 A * 2/1956 Miles ..... 446/26
2,785,596 A * 3/1957 Korosh ..... 84/422.1
2,811,811 A * 11/1957 Faranda ..... 446/26
2,933,832 A * 4/1960 Ayala et al. ..... 36/7.5
2,940,184 A * 6/1960 Malone ..... 36/1
3,170,360 A * 2/1965 Miettinen ..... 84/402
3,953,958 A * 5/1976 Beaston ..... 54/83.2
3,994,197 A * 11/1976 Bills ..... 84/418
4,043,241 A * 8/1977 Liu ..... 84/718
4,262,576 A * 4/1981 Gorsky et al. ..... 84/422.1
4,932,914 A * 6/1990 Aranda ..... 446/26
5,001,852 A * 3/1991 Schwartz ..... 36/139
5,325,542 A * 7/1994 Lenerville ..... 2/244
5,535,448 A * 7/1996 Williamson et al. ..... 2/22
D413,618 S * 9/1999 Murwin ..... D17/22
6,096,957 A * 8/2000 Andersen ..... 84/422.1
D446,238 S * 8/2001 Grey ..... D17/22
6,399,864 B1 * 6/2002 Willcutt ..... 84/418
6,620,991 B1 * 9/2003 Honiball ..... 84/402
6,955,582 B1 * 10/2005 Forbes et al. ..... 446/397
7,458,875 B1 * 12/2008 Forbes et al. ..... 446/397
7,482,520 B2 * 1/2009 Payerl ..... 84/402
7,534,948 B2 * 5/2009 Rice ..... 84/404
7,566,826 B1 * 7/2009 Stokdyk ..... 84/422.1
2005/0028667 A1 * 2/2005 Navarro ..... 84/418
2007/0234874 A1 * 10/2007 Taninbaum ..... 84/418
2008/0264237 A1 * 10/2008 Franz ..... 84/422.1

* cited by examiner

*Primary Examiner*—Jeffrey Donels
*Assistant Examiner*—Robert W Horn
(74) *Attorney, Agent, or Firm*—Venable LLP; Stefan J. Kirchanski

(57) ABSTRACT

A foot-operated musical percussion instrument is playable by either the left or right foot. The foot-operated device includes a hook and loop adjustable foot strap, toe-clip and frame to hold any of a wide range of percussive sound sources including tambourine jingles, maraca shakers and sleigh bells. The device is directly attached to the user's foot permitting simple, direct operation.

6 Claims, 2 Drawing Sheets

FOOT OPERATED PERCUSSIVE INSTRUMENT

CROSS-REFERENCE TO PRIOR APPLICATIONS

NA

U.S. GOVERNMENT SUPPORT

NA

BACKGROUND OF THE INVENTION

1. Area of the Art

The present invention is in the art of musical instruments and more particularly in the area of percussion instruments.

2. Description of the Background Art

The use of foot-operated percussive musical instruments is well known. For example, there is a wide range of pedal operated drums and cymbals. The most common design is a floor mounted foot pedal that causes a drum stick to impinge on a drum. In the case of cymbals, the foot pedal often causes one cymbal of a cymbal pair to be lifted above a second cymbal so that the first cymbal will fall into contact with the second cymbal when the pedal is released. This concept has also been extended to tambourines and related instruments. Such devices consist basically of structural configurations to hold and vertically or horizontally oscillate a tambourine or similar instrument.

For example, published U.S. Patent Application Number 200510028667 discloses a foot operated playing device for playing the tambourine with the left or right foot. This device is for playing the tambourine with either foot by attaching the removable strap to either foot. This allows the user to play more than one instrument at a time, such as a guitar and the tambourine. The foot operated device is suspended from the ground surface by the adjustable foot strap that is movable from left or right foot.

U.S. Pat. No. 6,096,957 discloses another foot operated tambourine playing device. The device comprises a base panel, a foot pedal pivotally coupled to the base panel. The foot pedal has a tambourine coupled to a lower surface. The upper surface of the tambourine foot pedal has a corrugated surface for frictionally engaging a foot.

U.S. Pat. No. 3,994,197 discloses yet another foot pedal drive for simulating tambourine hand-striking. The invention provides a tambourine type instrument that simulates a hand-impact operation through a foot operation which is controllable throughout the rocking cycle to provide a full range of light-to-heavy percussive effects in the full range of frequencies. This musical instrument oscillates a tambourine that has a rim by using a downward motion of the foot on a pedal of a pedal-assembly that mounts the tambourine.

U.S. published Patent Application Number 200710234874 discloses a tambourine comprising a rigid, enclosed, jingle-supporting frame that defines a center of gravity and a number of pairs of percussion jingles connected to the frame at determined locations around one of the frame's segments. The tambourine comprises a plurality of pairs of percussion jingles connected to the frame at predetermined locations. A handle for manually grasping the frame is provided which is connected to a second segment of the frame.

However, none of these references disclose a simple percussive instrument that can be directly manipulated by the user's foot.

SUMMARY OF THE INVENTION

The present invention provides a new and unique design construction which can be utilized for playing the tambourine or other installed sound sources directly with either foot by use of a toe-clip attached to the tambourine's inner frame and a stabilizing strap.

The general purpose of the device is to provide the new foot-operated musical device apparatus and method which has the advantages of the foot operated musical devices mentioned above along with novel features that results in a new and unique foot-operated musical device which is not anticipated, rendered obvious, suggested, or even implied by any of the prior art foot-operated musical devices.

To achieve this, the inventive device generally comprises a standard tambourine-frame hoop, a toe-clip molded to the inner frame of the circular tambourine hoop, an adjustable "hook and loop (Velcro®) strap, and a bottom edge that features soft cushioning to avoid unwanted "click" sound upon impact against floors.

There has thus been outlined the more important features of the inventive device so that the detailed description thereof that follows may be better understood, and so that the present contribution to the art may be better appreciated.

In this respect, before explaining at least one embodiment of the invention in detail, it is to be understood that the invention is not limited in its application to the details of construction and to the arrangements of the components set forth in the following description or illustration in the drawings. The invention is capable of other embodiments and of being practiced and carried out on various ways. Also, it is to be understood that the phraseology and terminology employed herein are for the purpose of description and should not be regarded as limiting.

As such, those that are skilled in the art of musical instruments will appreciate that the conception, upon which this disclosure is based, may readily be utilized as a basis for designing of other methods, structures and systems for carrying out the several purposes of the present Invention. It is important, therefore, that the claims be regarded as including such equivalent constructions insofar as the do not depart from the spirit and scope of the present invention.

It is therefore an object of the present invention to provide a new and unique foot operated musical device apparatus and method which has many of the advantages of the foot operated musical devices mentioned heretofore and many novel features that result in a new and unique foot operated musical device that is not rendered obvious, anticipated, suggested, or even implied by any of the prior art foot operated musical devices, either alone or in any combination thereof.

It is another objective of the present invention to provide a new foot operated musical device, which may be easily and efficiently manufactured and marketed.

It is a further objective of the present invention to provide a new foot operated percussion instrument, which is of a durable and reliable construction.

An even further important object of the present invention is to provide a new foot operated musical device which is susceptible of a low cost to manufacture with regards to both materials and labor, and which accordingly is then susceptible of low prices of sale to the consuming public, thereby making such foot operated musical device economically available to the buying public.

Still another object of the present invention is to provide a new foot operated musical device playable by merely inserting either foot into the toe-clip and fastening the adjustable strap.

Still another object of the present invention is to provide a new foot operated musical device that leaves the hands free for the users to play more than one instrument at a time, for example, the harmonica or the guitar or keyboards. Thus a solo act has a fuller sound.

Yet another object of the present invention is to provide a new foot operated musical device that is compact, occupies a minimal amount of space in a musician's luggage and requires essentially no set up.

These together with other object for the invention, along with the various features of the novelty which characterize the invention, are pointed out in the claims annexed to and forming a part of this disclosure. For a better understanding of the invention, its operating advantages and the specific objects attained by its uses, reference should be made to the accompanying drawings, in which like reference signs point out like structures, and descriptive matter in which there are illustrated embodiments of the invention.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved foot operated musical instrument.

Figure 1:
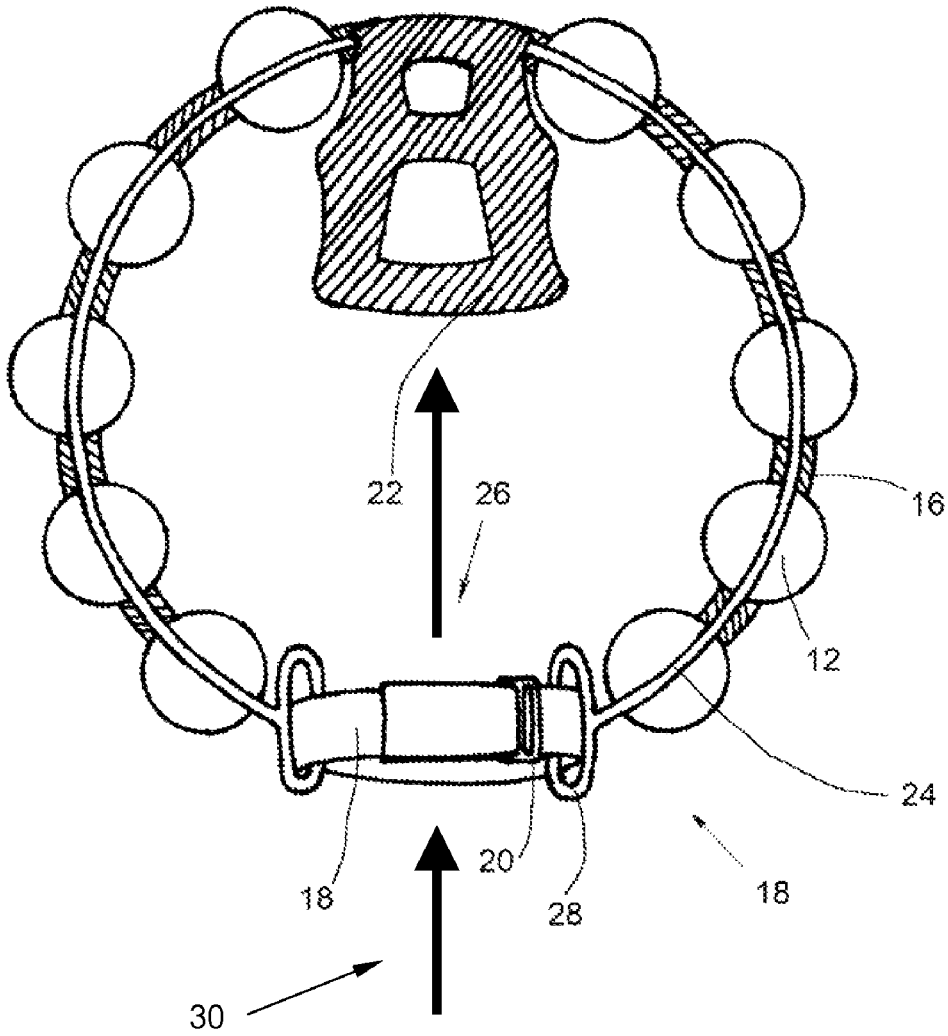
FIG. 1 is perspective view of the device from above.

FIG. 1 shows a perspective view of the device 10 from above. The device 10 contains one or more sound sources 12. Each sound source 12 is attached to a planar circular frame 24 which has a toe-clip or toe-rest attached to one end. The frame 24 can formed from any durable material such as plastic, metal or wood and in turn features a soft cushioning material 16 disposed on the bottom edge to avoid unwanted "click" sound upon impact against floors or other playing surfaces. The toe-clip 22 is preferably a plastic or metal cage-clip similar to the type found on bicycle pedals and is formed to surround at least the toe portion of the user's foot. The frame 24 has a foot opening 26 opposite the toe-clip 22 so the user's foot can be inserted through or into the frame. The frame is shown as being circular but any other shape such as rectangular, elliptical or hexagonal can be used so long as a clip is disposed at one end of the frame 24 and the foot opening 26 is provided opposite the toe-clip 22 for the insertion of the user's foot through the frame 24. The device 10 is used by inserting the toe of the user's right or left shoe through the opening 26, across the middle and into the opening toe-clip or toe rest 22 according to arrow 30. An adjustment mechanism is provided to improve the connection between the user's foot and the frame 24 at the opening 26. The adjustment mechanism could be a variety of easily manipulated mechanical linkages such as an elastic loop attached to the frame through which the foot must be inserted. A preferred adjustment mechanism is an adjustable strap 18 of hook and loop fastener (Velcro®) optionally with a buckle 20 provided so as to accommodate a variety of shoe sizes. The strap 18 is attached through eyes or hoops 28 on either end of the frame 24. It will be appreciated that the eyes 28 are only one possible way of attaching the strap 18 to the frame 24.

When the user's foot is inserted into the device 10, the frame 24 is parallel to dorsal-ventral plane of the foot so that the frame 24 can be envisioned as sort of an extension of the foot. Movement of the foot directly manipulates the musical instrument without an intervening pedal or similar mechanical linkage. When the frame 24 is shaken by the user's foot, sound sources 12 produce a readily controllable sound. The sound sources 24 are brass, stainless steel (or other suitable metal) tambourine jingles (pictured), sleigh bells, egg shakers or any other sound sources known to the art. It is possible to include a mixture of sound sources 12 to produce unique sounds. It is possible to provide modular sound sources that can be attached or removed from the frame 24 at will.

Figure 2:
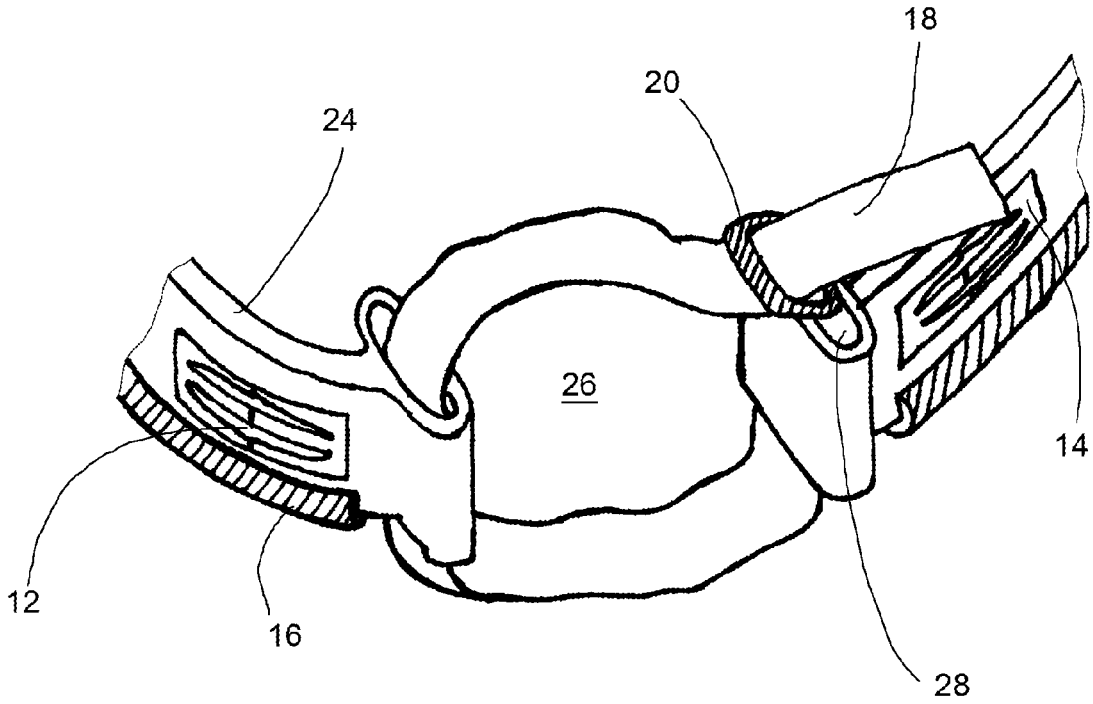
FIG. 2 is a partial perspective view of the device from the side showing the foot strap, the foot opening and the sound sources.

FIG. 2 is a side perspective view of the device 10 showing the opening 26. The device 10 includes a series of sound sources 12. The sound sources 12 may be stacked on an axle like the jingles of a tambourine. Other means of attachment and configurations of sound sources 12 may also be used. The sound sources 12 are attached to the frame 24 and are often partially enclosed by the frame 24 within an opening 14. Generally, the frame 24 can be formed from any durable material such as plastic, metal or wood and in turn preferably features a soft cushioning material 16 (felt, foam or the like) on the bottom edge to avoid unwanted "click" sounds upon impact against floors or other playing surfaces. Besides shaking the device 10 in the air, it is also possible to produce interesting percussive sounds by tapping the entire device onto the floor (or other surface)—this is where cushioning material 16 comes into play by deadening the sharp sound of the frame 24 contacting the floor. When the user's foot is inserted into the instrument 10, the sole of the user's shoe can preferably be in contact with the floor so that wearing the instrument 10 does not compromise the user's balance or mobility.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. A foot operated percussive instrument comprising:

a planar frame;

percussive sound sources attached to the frame disposed to generate sound when the frame is shaken;

the frame further comprising:

an opening on a first side of the frame through which a user's foot can be inserted;

a foot clip or rest attached to the frame opposite the opening and disposed to accept at least the toe end portion of the user's foot; and adjustment means at the opening for removably affixing the frame to middle of the user's foot so that the user can play the percussive instrument by moving the frame affixed to the user's foot.

2. The percussive instrument as claimed in claim 1 further comprising a layer of cushioning material attached to a lower edge of the frame.

3. The percussive instrument as claimed in claim 1, wherein the adjustment means is a flexible strap and buckle.

4. The percussive instrument as claimed in claim 3, wherein the flexible strap is a hook and loop strap.

5. The percussive instrument as claimed in claim 1, wherein the adjustment means is a flexible hook and loop strap.

6. A foot operated percussive instrument comprising:

a planar frame;

a layer of cushioning material attached to the lower edge of the frame;

percussive sound sources attached to the frame disposed to generate sound when the frame is shaken;

the frame further comprising:

an opening on a first side of the frame through which a user's foot can be inserted;

a foot clip or rest attached to the frame opposite the opening and disposed to accept at least the toe end portion of the user's foot; and adjustment means at the opening for removably affixing the frame to middle of the user's foot so that the user can play the percussive instrument by moving the frame affixed to the user's foot.

* * * * *